United States Patent [19]

Pauli

[11] Patent Number: 5,033,396

[45] Date of Patent: Jul. 23, 1991

[54] GRILL ARRANGEMENT, PARTICULARLY FOR STEPPED PIVOTING GRILLS

[76] Inventor: Balduin Pauli, Bergstrasse 34, D-8035 Gauting, Fed. Rep. of Germany

[21] Appl. No.: 382,631

[22] PCT Filed: Feb. 16, 1988

[86] PCT No.: PCT/EP88/00113

§ 371 Date: Aug. 1, 1989

§ 102(e) Date: Aug. 1, 1989

[87] PCT Pub. No.: WO88/06256

PCT Pub. Date: Aug. 25, 1988

[30] Foreign Application Priority Data

Feb. 18, 1987 [DE] Fed. Rep. of Germany ..... 37051

[51] Int. Cl.[5] ..... F23H 7/08

[52] U.S. Cl. ..... 110/281; 110/291

[58] Field of Search ..... 110/291, 299, 300, 281, 110/282, 283

[56] References Cited

U.S. PATENT DOCUMENTS

| | | | |
|---|---|---|---|
| 2,137,158 | 11/1938 | Douglass | 110/281 |
| 3,985,084 | 10/1976 | Delaplace | 110/281 |
| 4,170,183 | 10/1979 | Cross | 110/291 |
| 4,598,651 | 7/1986 | Flickinger et al. | 110/282 |
| 4,600,098 | 7/1986 | Orren | 110/281 |
| 4,671,190 | 6/1987 | Moreau | 110/281 |
| 4,732,561 | 3/1988 | Eiring et al. | 110/291 |

FOREIGN PATENT DOCUMENTS

| | | | |
|---|---|---|---|
| 916448 | 8/1954 | Fed. Rep. of Germany . | |
| 911889 | 2/1956 | Fed. Rep. of Germany . | |
| 2833255 | 2/1980 | Fed. Rep. of Germany . | |
| 520124 | 6/1921 | France | 110/281 |
| 1103946 | 11/1955 | France | 34/164 |
| 1267600 | 9/1960 | France | 110/281 |

*Primary Examiner*—Henry A. Bennett
*Assistant Examiner*—Denise L. F. Gromada
*Attorney, Agent, or Firm*—Dvorak and Traub

[57] ABSTRACT

The invention relates to a grill arrangement, particularly for stepped pivoting grills, with feeding means, possibly drying and firing grills and at least one vertical grill with associated horizontal grill as well as a firing burnout grill and is distinguished by at least one swirling component step (3) in the stepped pivoting grill.

4 Claims, 10 Drawing Sheets

GRILL ARRANGEMENT, PARTICULARLY FOR STEPPED PIVOTING GRILLS

The invention relates to a grill arrangement, particularly for stepped pivoting grills, comprising feeding means, possibly drying and firing grills and at least one vertical grill with associated horizontal grill as well as following burnout grill.

Such stepped pivoting grills have proved themselves very well in practice. It is already known (P 28 33 255.0) to provide such stepped pivoting grills, the individual steps of which each consist of a horizontal and a vertical grill, with air-cooled grill bars, the air being introduced for example centrally in the grill bar, distributed to both sides via passages beneath the grill bar upper side and the air being discharged into an air distributing box which is located beneath the horizontal and vertical grill, from whence it enters the combustion chamber via the slots between the grill bars along the flanks of the latter and the masonry.

The intention is now to further develop this extremely advantageous construction so that the combustion performance is increased and intensified and the combustion process optimized and the firing-dependent pollutants, for example $NO_x$, CO, $C_{total}$ and the production of hydrocarbon $C_nH_m$ are minimized.

This is surprisingly achieved according to the invention in a grill arrangement of the type mentioned at the beginning by at least one swirling or vortex component step in the stepped pivoting grill.

Preferably, the swirling component steps are so constructed that at least some grill bars have blowout or discharge openings for air. It is favourable for high velocity nozzles to blow out perpendicularly to the horizontal grill plane.

The aforementioned problem is thus completely solved by the step according to the invention, i.e. the combustion performance is considerably increased and intensified, the combustion process optimized and the firing-dependent pollutants such as for example $NO_x$, CO, $C_{total}$ and hydrocarbon $C_nH_m$ are minimized.

Via the so-called vortex or swirling components (swirling step in the frame of a stepped grating) absorption agents such as lime may also be added, thereby bonding pollutants.

In addition, a surface area increase of the fuels is obtained by abrasion in the fluidizing zone; the combustion process is thereby favourably influenced. This takes place in particular on addition of centrifuged sewage sludge including dry substances of about 30% to the refuse and burning the refuse and sewage sludge together.

In the region of the pivoting grill elements equipped with so-called swirling or vortex components a quasi fluidized bed is formed through which the fuel must pass along its path.

The transport of the fuel and the transport of the fuel residues and their distribution takes place in the usual manner as employed on any grill system, in particular stepped grill system.

Thus, the good properties of a grill and fluidized bed firing are combined by such a system.

The resulting fluidized bed additionally provides a fuel transport or residue transport. The residues are finally discharged via a deslagging system of known type.

In a further development of the invention the swirling nozzles are to be still better protected, the grill arrangement kept still cleaner and the temperature resistance still further increased as far as possible.

Preferably, for this purpose the grill bars of the horizontal grill arrangement comprise a slag-repellant ceramic covering of high temperature resistance embedding the swirling nozzles. This can also be done at least in the lower portion of the vertical grills.

Preferably, the ceramic covering consists of slag-repellant silicon carbide which for example can be stamped on. The ceramic material itself thus has an additional holding by the swirling nozzles. The arrangement of horizontal grills with distributors and such grills is suitable in particular for special refuse such as hospital or chemistry waste which are partially introduced in bundles with liquid content or become pasty or liquid in the burning off phase. The grill construction here is absolutely sealed towards the bottom.

The high velocities with which the air leaves the swirling nozzles do not permit any penetration of liquids into the nozzles themselves. The slag-repellant ceramic material which is suitable for very high thermal stress exhibits high resistance to wear and long service life compared with the previously used highly refractory Sicromal steels.

The novel firing concept thus offers a real alternative for plants with relatively small special refuse throughput capacities of 100 kg/h up to a maximum of 2 t/h compared with the proved rotary tube furnaces. With the step according to the invention, i.e. the specific air guiding and the firing space adapted to the combustion process with high residence times for the flue gases in the high temperature range, the firing-dependent pollutants such as CO, $NO_x$, total C, dust and traces of furanes and dioxins are optimally reduced.

The ceramic material covering can also be provided in the region of the swirling nozzles in pivoting grills. In this case as well in the regions of the grill bar where the swirling nozzles are arranged an extremely intensive burning with high thermal loading of the grill material is present. Optionally, the ceramic material may also be bricked on. The grill bars may also be supplied individually already finished. In surprising manner the invention utilizes the favourable properties of silicon carbide (for example Ullmann Volume 21, page 431 to page 436).

Examples of embodiment of the invention will now be explained in detail with the aid of the enclosed drawings, wherein.

Figure 2:
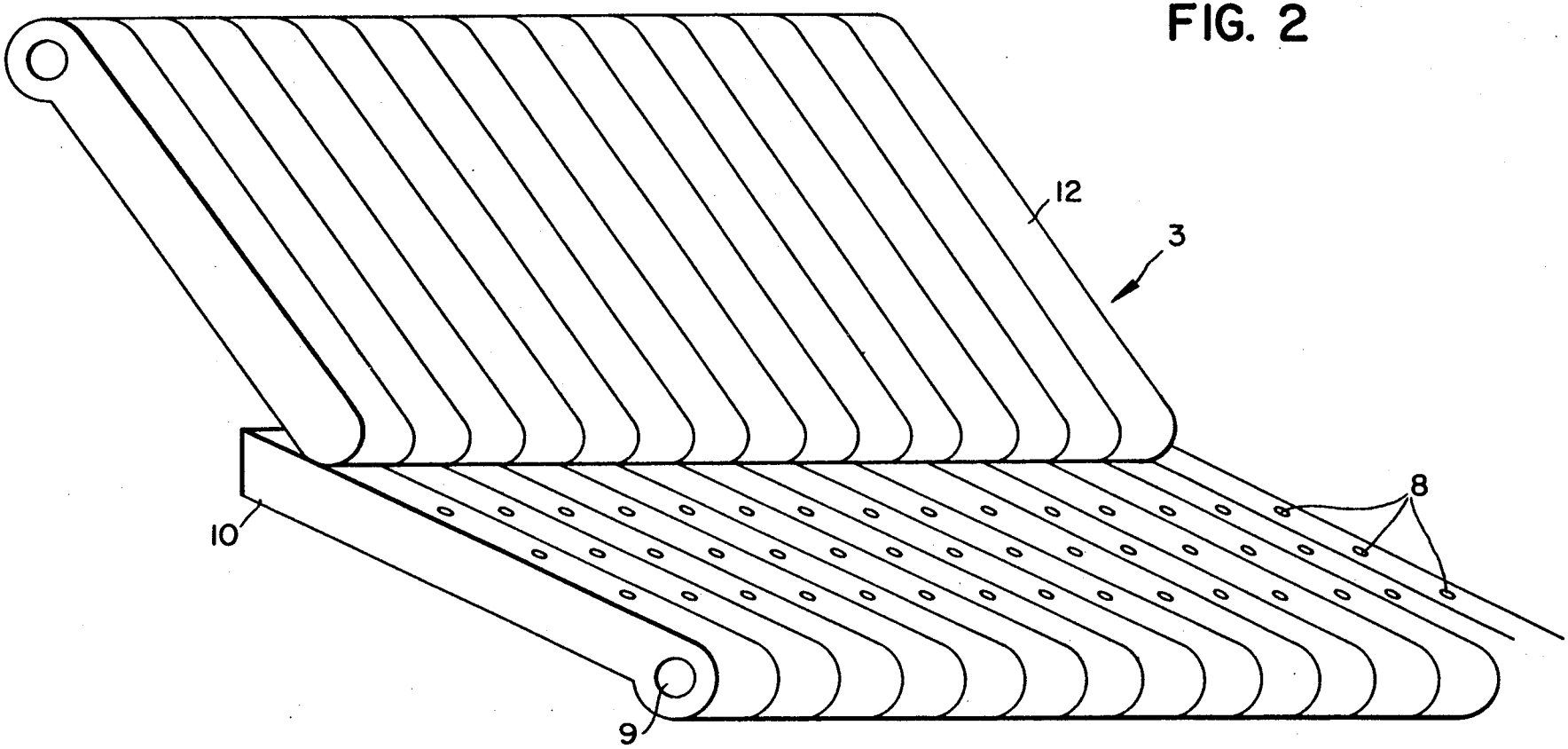
FIG. 2 shows a step of the stepped pivoting grill according to FIG. 1.
Figure 3B:
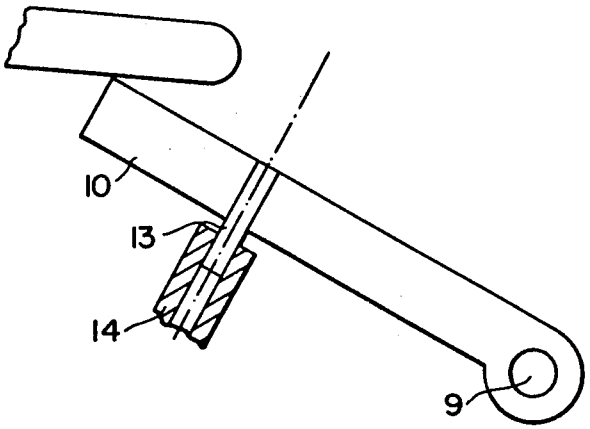
Figure 3A:
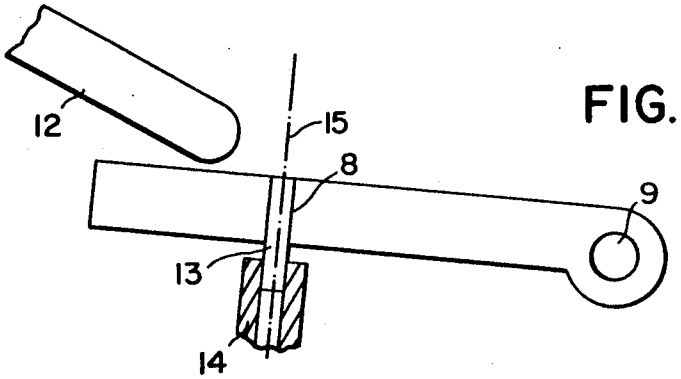
Figure 4:
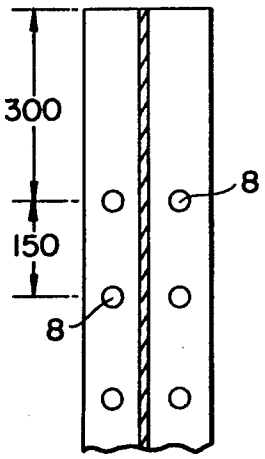
Figure 5:
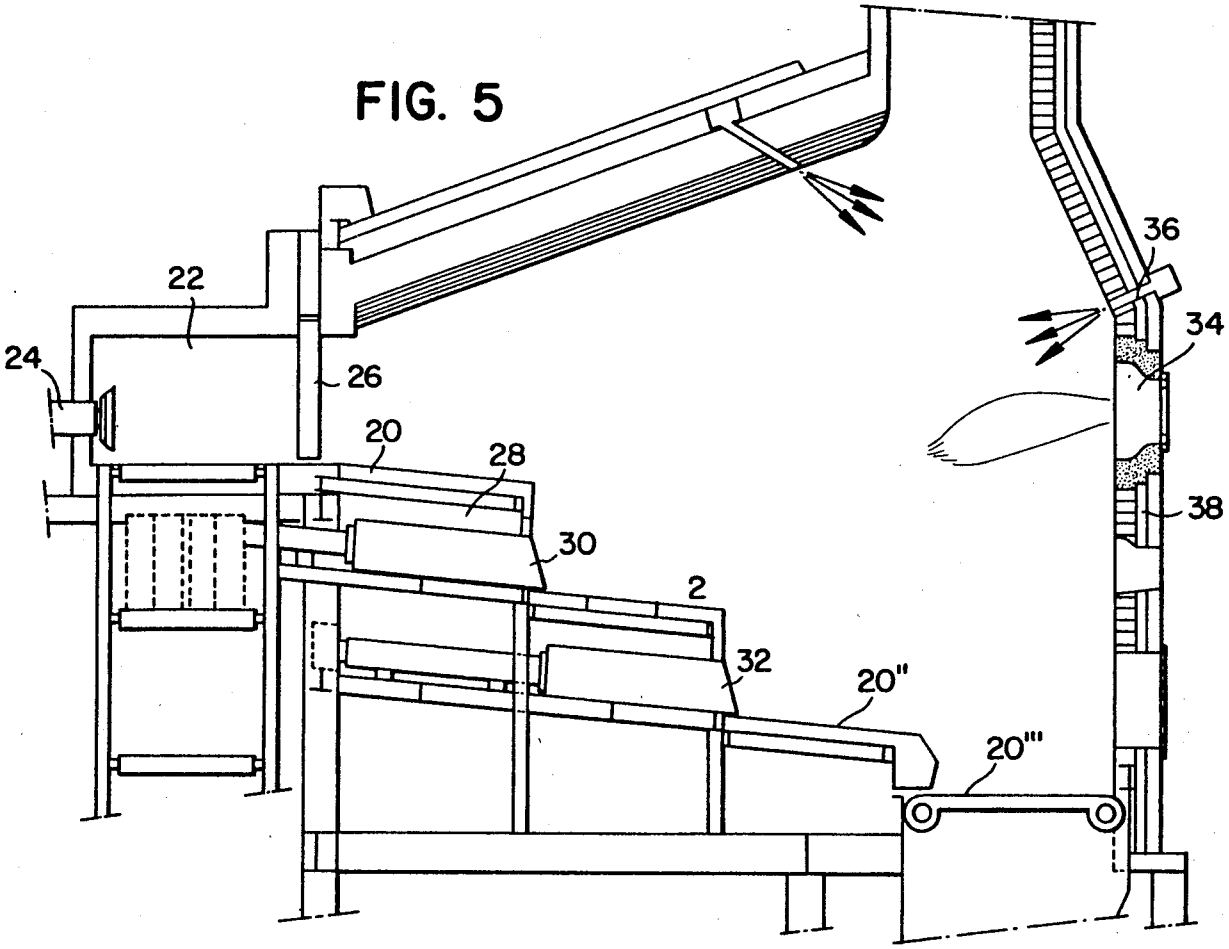
Figure 6:
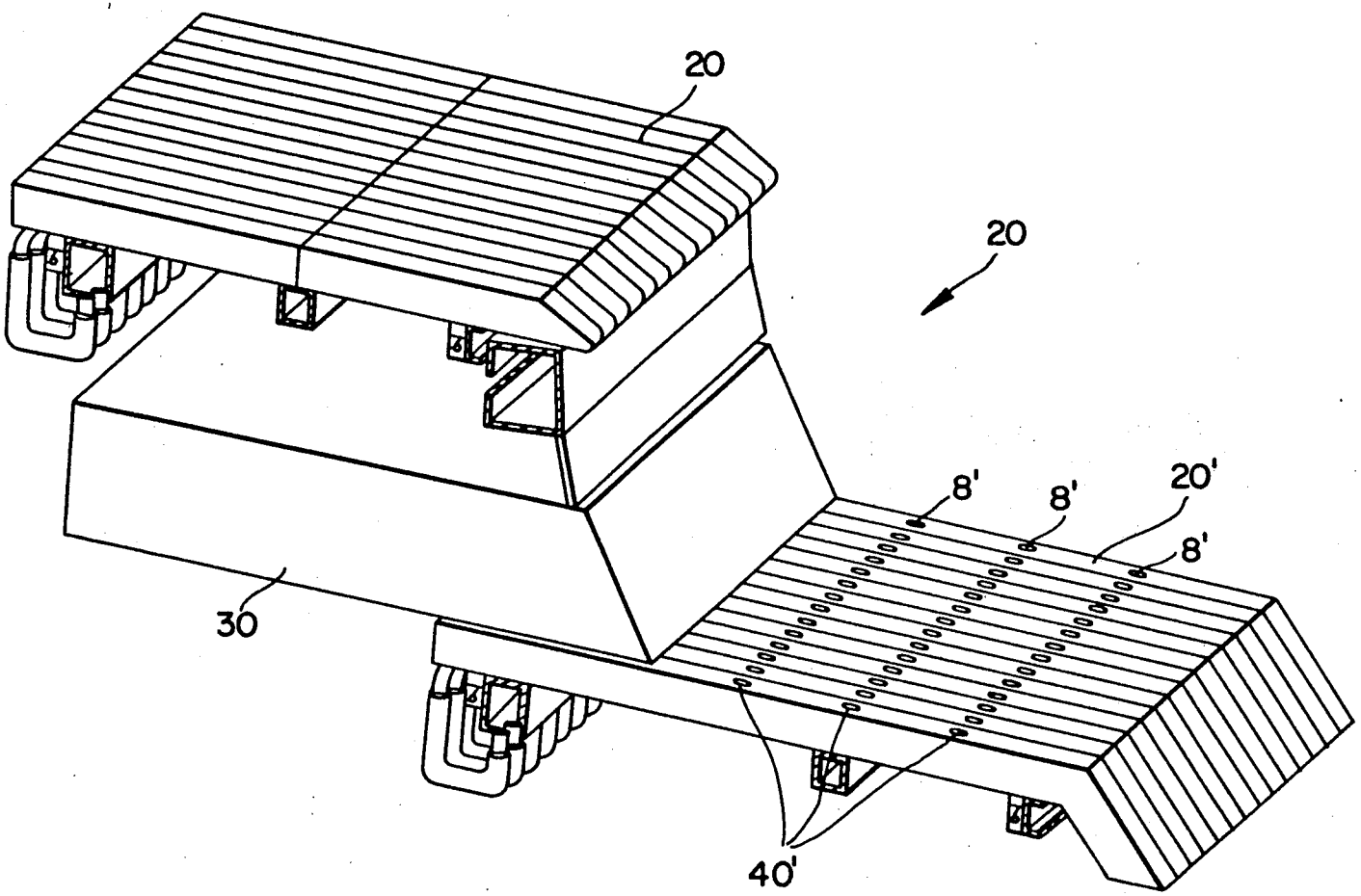
Figure 7:
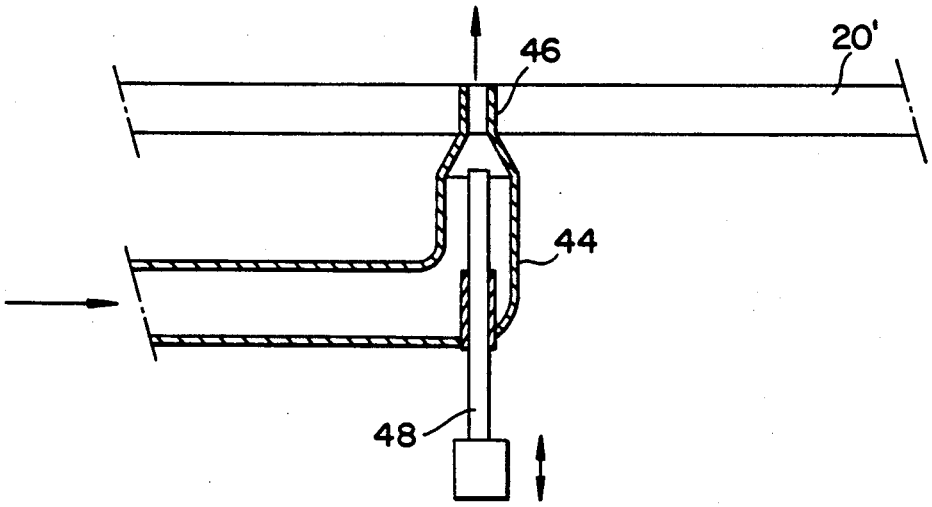
Figure 8:
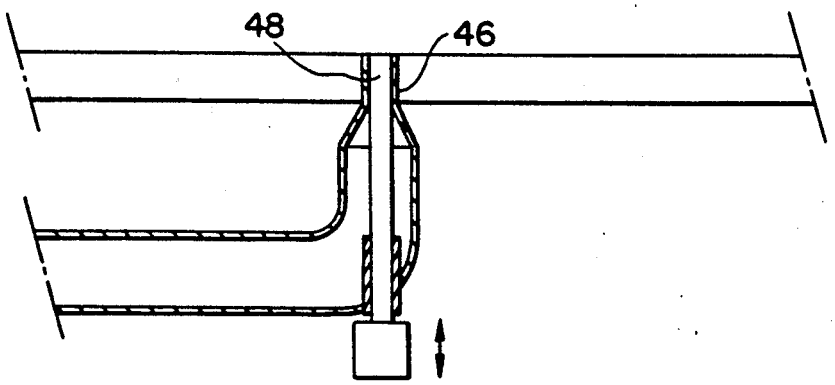
Figure 10:
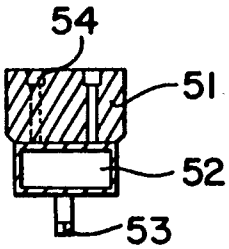
Figure 9:
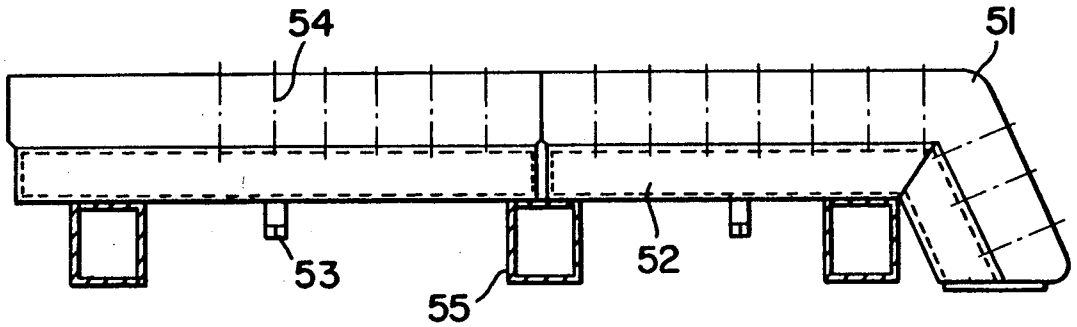

FIG. 3*a* shows a first portion of two associated grill bars of a stepped grill step;

FIG. 3*b* shows a second position of two associated grill bars of a stepped grill step;

FIG. 4 is a detail of FIGS. 2 and 3;

FIG. 5 shows a multistep feed grating with swirling components;

FIG. 6 shows a feed grating element taking particular account of the fluidizing zone;

FIGS. 7 and 8 show a nozzle arrangement with air shutoff means, FIG. 7 with opened nozzle and FIG. 8 with closed nozzle;

FIG. 9 shows a further embodiment of a horizontal grill bar with special protection;

FIG. 10 is a transverse section corresponding thereto and

Figure 11:
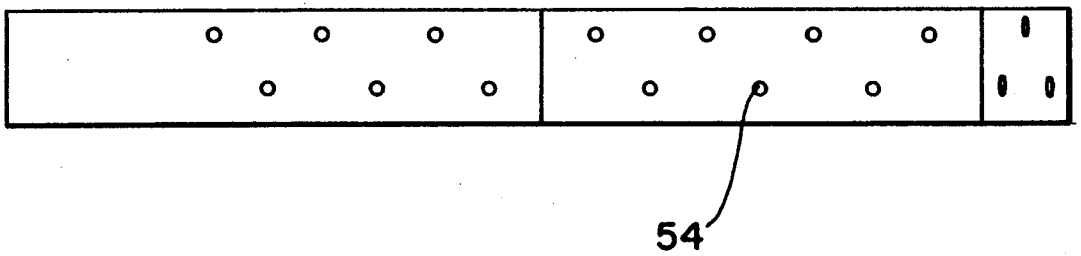
Figure 13:
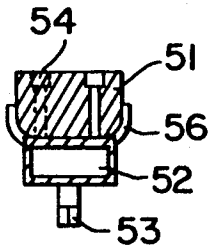
Figure 12:
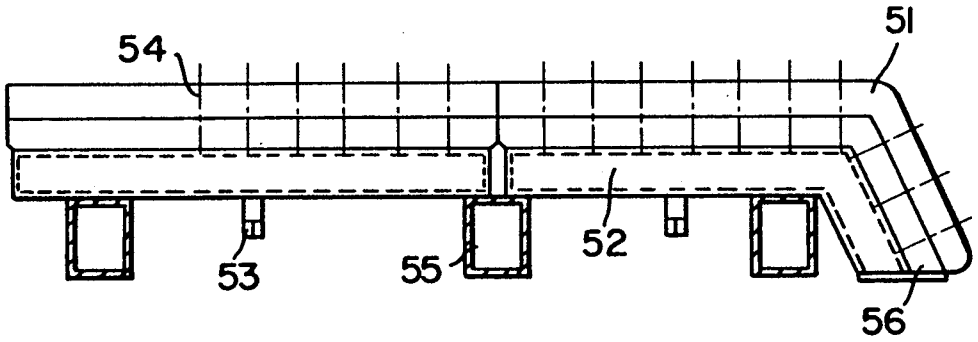
Figure 14:
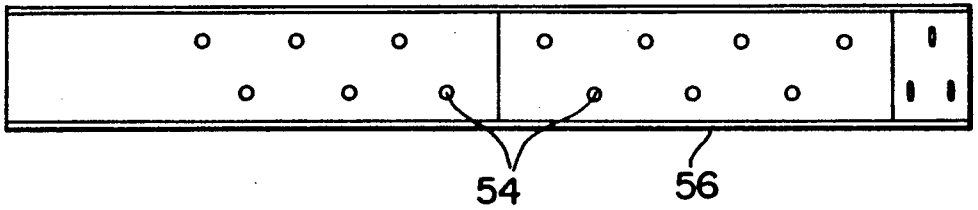
Figure 15:
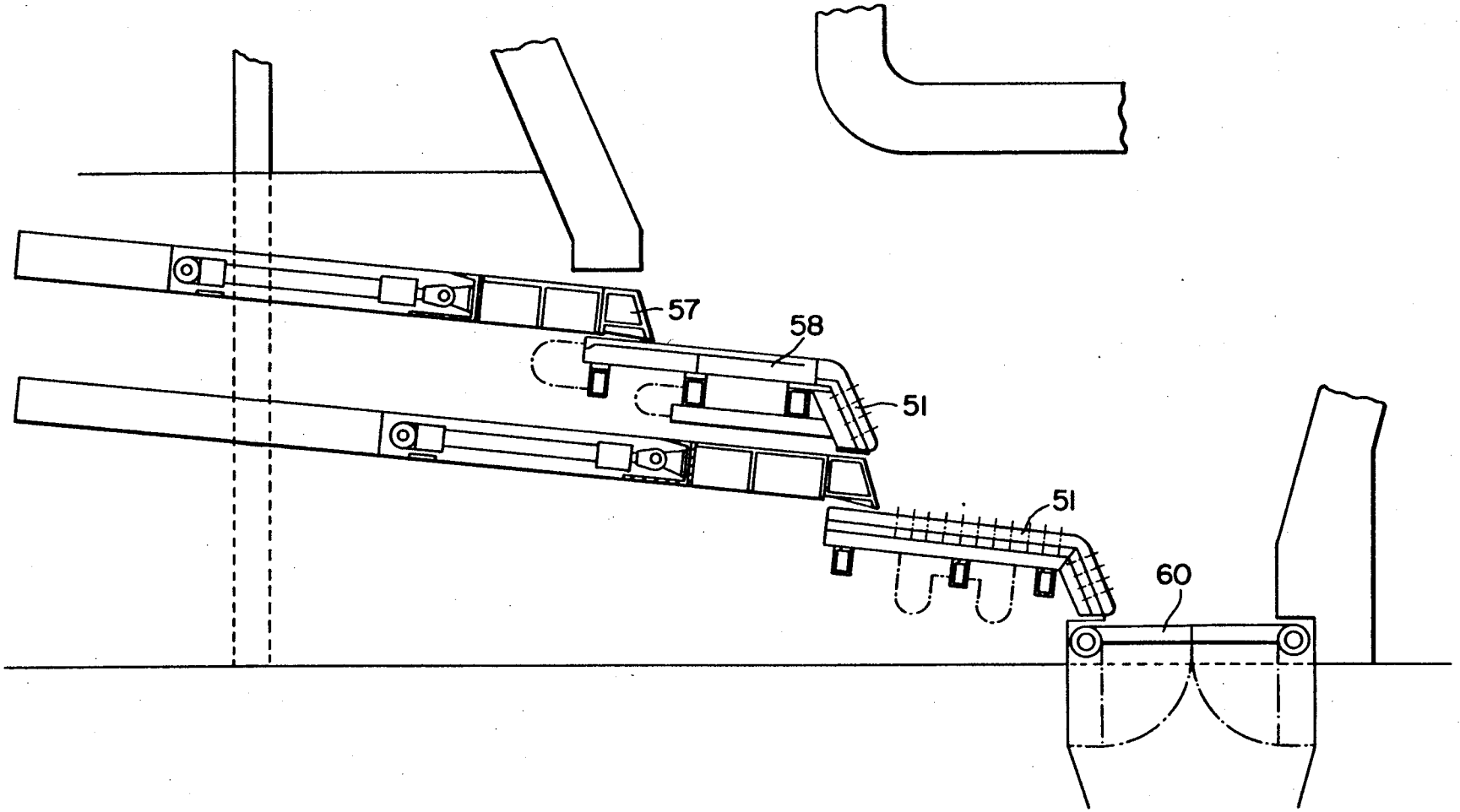

FIG. 11 is a plan view corresponding to FIG. 9;

FIGS. 12 to 14 show an arrangement similar to FIGS. 9 to 11 but with a different mounting of the ceramic lining or covering;

FIG. 15 shows schematically horizontal grill arrangements with distributor and

Figure 16:
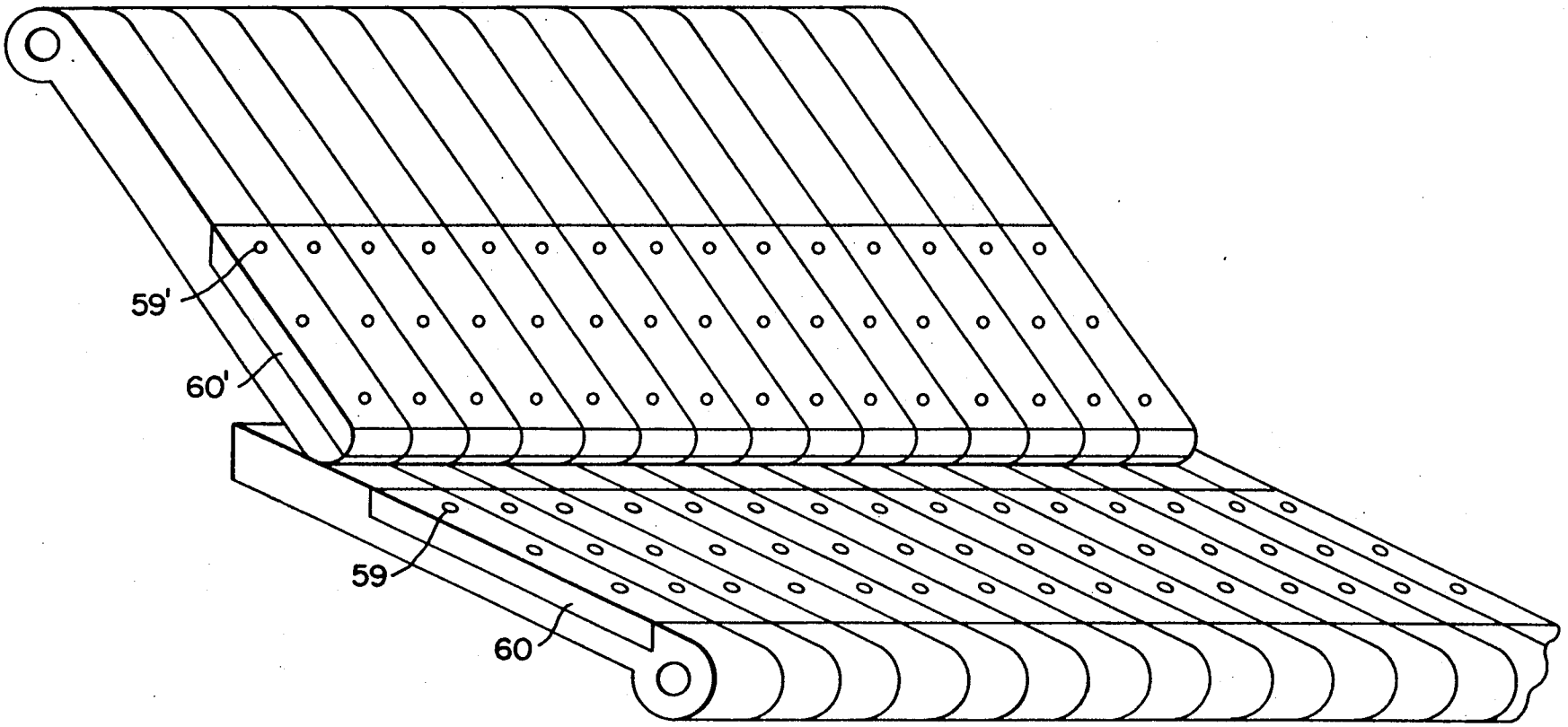

FIG. 16 shows details of a pivoting grill step.

Figure 1:
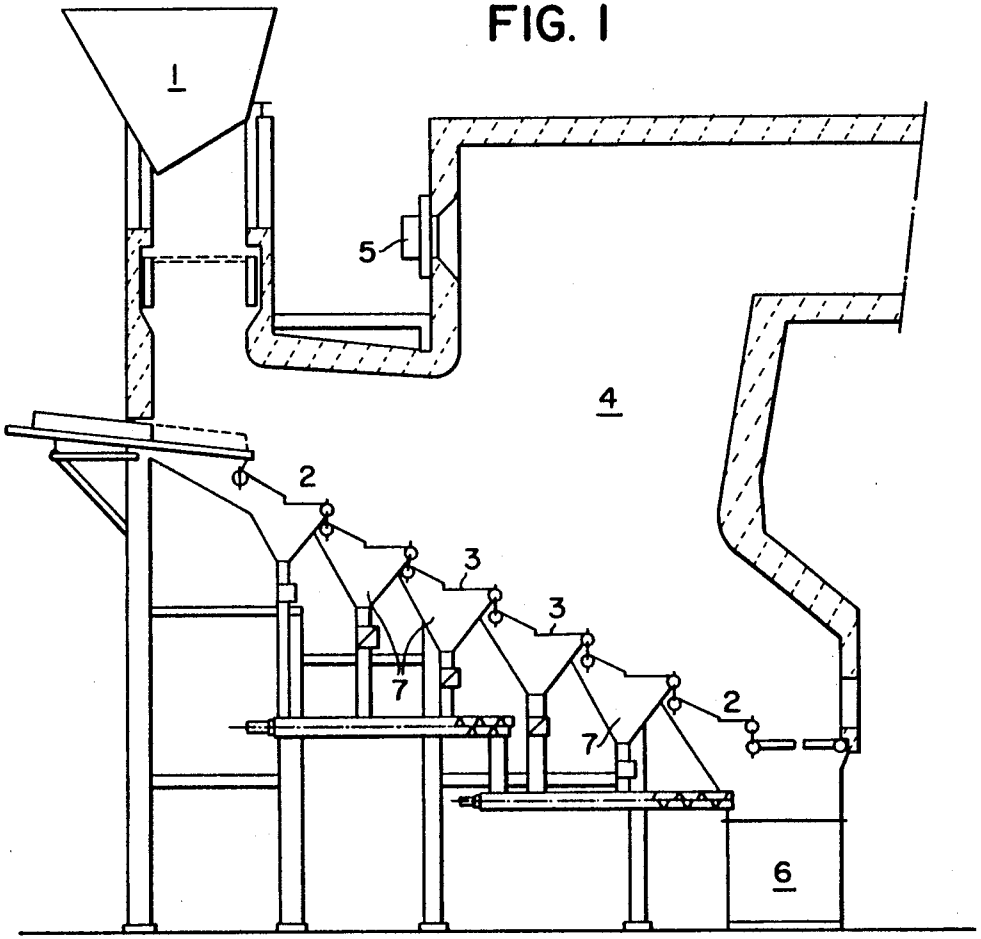
FIG. 1 is an overall view of an embodiment according to the invention.

FIG. 1 shows a stepped pivoting grill system comprising a refuse hopper 1 with charging flap, distributing slide, not shown, and pivoting grill system which consists for example of two stepped pivoting grill steps 2 (each consisting of a vertical grill and a horizontal grill) and (at the end of the grill) a further pivoting grill step 2, a burnout grill not shown and a deslagging means 6. Connected into the stepped pivoting grill system are so-called swirling components 3 (two steps in each of which a fluidized bed is generated, or steps in which at least swirling air is blown out). The firing space 4, arrangement and configuration of the burner 5 and the arrangement of the air distributor boxes 7 is known per se.

Thus, in the region of the so-called swirling components air is blown out in turbulence from below in any desired manner. In this region in a manner completely unusual hitherto in the stepped pivoting grill field (presumably also unusual in the stepped grill field) a fluidized zone, i.e. a quasi fluidized bed, is generated. This must be traversed by fuel directed fundamentally downwards in its movement. Said fuel can consist of refuse, partially dried sewage sludge or other usually difficultly combustible solid or semiliquid "fuels".

The waste or refuse passed from the refuse hopper 1 onto the shutoff flaps, not shown, may possibly be predried there or later after falling onto the distributing slide and then supplied to a drying and firing grill 2. The firing can thus take place even in the region of the first and second stepped pivoting grill element. At the latest on transfer of the fuel to the stepped pivoting grill steps 3 operating with a sort of fluidized bed the process described above takes place: the lighter fuel fractions are raised and further burnt in the fluidized bed. Abrasion takes place. The combustion cycle is promoted by the increase in the surface area, in particular when centrifuged sewage sludge with dry substance contents of about 30% have been added. On the two designated steps with fluidized bed 3 from the combustion technology point of view the good properties of a grill firing are thus combined with a fluidized bed firing. After passing through the two pivoting grill elements 3; 3 for combustion and swirling the fuel is transferred to two pivoting grill elements 2 for burning out and residue transport.

The air supply of the two pivoting fuel elements 3 for combustion and turbulence is provided in particular for cooling the grill bars (not shown). As a result (FIG. 2) to each grill bar in the centre cooling air is supplied from below, for example from an air distributing box which is not shown and which can be provided within or outside an air funnel 7 (FIG. 1). Generally, the air is guided via a cap welded for example onto the grill bar upper side (likewise not illustrated). The centrally supplied air leaves at the end face on the one hand in the region of the pivot mounting for the grill bars and on the other hand in the region of the opposite grill bar end. The same applies to the grill bars of the vertical section. Air is then blown out of the air distributing box 7 by means of a respective fan via nozzles 8 into the firing space and ensures the swirling outlined.

In the present example of embodiment each grill bar of the horizontal grill comprises three nozzles 8 which are provided substantially in the centre between the pivoting grill mounting 9 and the grill bar end 10. The nozzles are otherwise uniformly distributed over the entire width of the grill bar. In the example of embodiment three rows of such nozzles are provided and form the fluidizing zone. The exit of high velocity air of separate fans results in fluidizing and turbulence of the fuel: the lighter fuel fractions are subjected in certain manner to abrasion and diminution and in suspension are burnt or transported onto the burnout grills 2'. The heavier fuel fractions are transported both with the aid of the lifting movements of the pivoting grills and by the dynamics of the air leaving the nozzles 8 onto the burnout elements 2'.

The residues of the substances burnt in suspension are discharged after the fluidizing zones 3; 3 with the flue gas stream or via the burnout elements 2' and the deslagging means 6. Since the nozzles are mounted in the pivotal grill element the pivot movements bring the nozzles into a different position and this changes the discharge angle of the nozzle air compared with the general stream of flue gases in the firing space. This is shown clearly in particular in FIG. 3. The raising of the vertical grill 12 takes place in the usual manner on actuation of the grill element 9; 10.

According to the example of embodiment the nozzles are formed by a Sicromal tube 13 on which a metal flexible tube 14 is mounted as air supply conduit.

FIG. 4 shows a further detail. Two adjacently disposed grill bars each carry three nozzles 8 of which the diameters may be 2 to 10 mm depending on the air discharge velocity. To achieve particularly good turbulence in a conventional stepped pivoting grill the intermediate spaces between the nozzles is made 150 mm and the distance from the edge of the grill bar 300 mm.

It is of course also possible to incline the axes 15 of certain nozzles with respect to the axes of other nozzles, for example so that in accordance with FIG. 2 the axes of the centre nozzle rows of nozzles 8 blow out perpendicularly to the grill and those of the inner and outer nozzle rows blow out at an angle to the centre nozzle row.

If adsorption agents, for example lime, are to be blown out then the nozzle exit, the nozzle interior slide face and the nozzle diameter can be adapted accordingly should this be considered necessary.

A further embodiment is shown in FIGS. 5 to 8.

This is a stepped grill having three grills 20, 20' and 20'' and a burnout grill 20'''. Refuse, for example hospital waste, is introduced into the lock hopper 22 for example via a lifting apparatus and generally in bags. A slide piston 24 periodically pushes the hospital refuse forwardly with opening of a firing space flap 26. After predrying on the grill 20 the refuse drops or is pushed onto the grill 20'. In the region beneath the grill 20 primary air 28 is supplied. After partial burning out on the grill 20' a distributor 30 pushes the refuse down off the grill 2. The same happens on the next step by the distributor or feeder 32. The burnout grill 20''' is otherwise formed in the usual manner. A power and heating-up burner 34 is supplied with secondary air 36 at an angle (both provided in the masonry 38). A detail of the grill step 20' is shown in FIG. 6. Identical reference numerals are used for identical parts in the two figures.

The grill 20' is again formed as fluidizing zone with three nozzle rows 40' of nozzles 8' and has been found expedient. The invention is however not restricted thereto. Since hospital refuse is partially pasty, liquid or in slurry form, special nozzle shapes are provided. These are a nozzle shape (FIGS. 7 and 8) in which the air leaves the tube 44 and enters a reduced tube piece (nozzle 46). The nozzle 46 is opened and closed by a ram or push member 48. The ram is part of a rake. All the nozzles of a row or some of the nozzles of a row can be opened or closed by means of the respective push members 48 via said rake. The closed state is shown in FIG. 8. The push member is a refractory ram generally consisting of solid material.

Since the multistep feed grill with stationary and cooled (not separately shown) grill bars is equipped for burning hospital refuse and other special refuse which includes pasty and tacky materials, the additional air discharge nozzles 8' are provided. These discharge nozzles represent swirling or vortex components which can be closed, also using differently constructed means, in such a manner that on starting and stopping and during operation of the system liquid, pasty or tacky substances cannot get into the nozzles. FIGS. 7/8 explain the possibility of cleaning the nozzles from residues by introducing the rams or push members (nozzle locked). Each rake equipped with rams at the nozzle intervals carries 8 to 15 nozzles.

With for example three nozzle rows it is thus possible to close one or two nozzle rakes, the air time allocation and thus the combustion process thereby being controlled.

The passages of the rake system from the incoming air system are sealed in air-tight manner. The arrangement and configuration of the sealing system in the region of the incoming air system of the nozzles is illustrated in FIGS. 7/8.

The nozzles are for example cleaned in that the distributor 30 is advanced and thus cleans the nozzle mouths or nozzle heads. After withdrawing the distributor a more rapid burning of the pasty possibly remaining residue takes place.

During startup the nozzles are sealed or closed. This prevents the entry of tacky, pasty or liquid substances during the startup and also moreover during operation.

FIG. 9 shows a grill bar with ceramic material covering 51 into which the swirling nozzles 54 are embedded. The ceramic covering consists (in FIGS. 9 to 16) of slag-repellant material of high temperature resistance. It is applied to a steel carrier 52 which has at the same time the function of an air supply passage with the air supply tubes 53 necessary for that purpose. The grill bar rests in a manner known per se on support beams 55.

According to FIGS. 12 to 14 for additional holding of the ceramic material applied to the steel beams 52 a lateral holding means is provided. The latter may also consist of Sicromal steel. As shown in FIGS. 13 and 14 said holding means engages round the stiffened material and extends rail-like on either side of the grill bar, preferably over the entire length thereof. The ceramic material covering in this embodiment is held firstly by the air-supplying steel beams 52, then by the nozzles 54 and then also by the lateral holding means 56. The grill bar itself rests on the support beams 55 and is sealed downwardly in air-tight manner.

FIG. 15 shows an arrangement of two horizontal grills having feeders or distributors 57 known per se and the grill bars 58. This horizontal grill arrangement in step form with distributors is suitable in particular for special refuse such as hospital and chemical wastes which are introduced partially in bundles with liquid content or become pasty or liquid in the burning-off phase. Since the grill construction is absolutely sealed downwardly and thus no liquids can drip through the grill the design is a convincing one for special refuse. The masonry and burnout grill 60 are only indicated.

FIG. 16 shows practically the same illustration as FIG. 2 except that in addition to the nozzles 59 (designated by 8 in FIG. 2) of the horizontal grill in this case swirling or vortex nozzles 59' are also provided in the lower region of the vertical grill section of FIG. 16. Consequently, the ceramic lining or covering 51 of the previous figures (here denoted by 60 and 60') is provided both in the vertical grill and in the horizontal grill around the swirling nozzles. The slag-repellant ceramic covering embedding the swirling nozzles is again of high temperature resistance. The vertical grills thus additionally carry nozzles 59' in the slag-repellant ceramic bed at least in their lower portion.

I claim:

1. Grill arrangement suitable for stepped pivoting grills, comprising: feeding means, drying and firing grills, at least one substantially vertical pivotable grill, a substantially horizontal pivotable grill associated with said vertical grill, a burn-out frill associated with said vertical grill, a burn-out grill disposed downstream of said vertical and horizontal grills, a plurality of closable high velocity horizontal grill nozzles disposed transversely across said horizontal grill, and a plurality of closable high velocity vertical grill nozzles disposed transversely across said vertical grill.

2. Grill arrangement according to claim 1, further comprising a cylindrical nozzle ram which is capable of acting against said nozzles so as to close said nozzles.

3. Grill arrangement according to claim 2, further comprising translationally displaceable rakes, said nozzle rams being disposed on said rakes.

4. Grill arrangement suitable for stepped pivoting grills, comprising: feeding means, drying and firing grills, at least one substantially vertical pivotable grill, a substantially horizontal pivotable grill associated with said vertical grill, a burn-out grill disposed downstream of said vertical and horizontal grills, a plurality of high velocity horizontal grill nozzles disposed transversely across said horizontal grill, a plurality of high velocity vertical grill nozzles disposed transversely across said vertical grill, a high temperature resistant, slag-repellant ceramic covering disposed on said horizontal grill, said horizontal grill nozzles being embedded in said ceramic covering, and lateral holders disposed on said horizontal grill, said holders extending around a portion of said ceramic covering so as to secure said ceramic covering against said horizontal grill.

* * * * *